United States Patent [19]

Chapman

[11] 4,053,954

[45] Oct. 18, 1977

[54] BATHTUB CADDY

[76] Inventor: George Chapman, 1712 Park Blvd., Cherry Hill, N.J. 08002

[21] Appl. No.: 697,239

[22] Filed: June 17, 1976

[51] Int. Cl.[2] ..... A47K 3/12

[52] U.S. Cl. ..... 4/185 AB; 4/185 R; 220/19; 4/1

[58] Field of Search ..... 4/1, 185 R, 185 AB, 4/185 S; 220/19

[56] References Cited

U.S. PATENT DOCUMENTS

| | | | |
|---|---|---|---|
| 2,006,169 | 6/1935 | Harris-Jones | 4/185 R |
| 2,150,483 | 3/1939 | Bantz | 4/185 R |
| 2,167,795 | 8/1939 | Bantz | 4/185 R |
| 2,183,441 | 12/1939 | Bantz | 4/185 R |
| 2,302,806 | 11/1942 | Senter | 4/185 R X |
| 2,581,613 | 1/1952 | Ullrich | 220/19 |
| 3,065,877 | 11/1962 | Wilson | 220/19 X |
| 3,239,850 | 3/1966 | Kiss | 4/185 R |
| 3,373,448 | 3/1968 | Butler | 4/1 |

*Primary Examiner*—Henry K. Artis
*Attorney, Agent, or Firm*—Posnack, Roberts & Cohen

[57] ABSTRACT

Two identical shelf halves are provided, each half having a first shelf level for supporting thereon bath articles, and a second shelf level of greater depth for storing therein bottles and the like. The halves are supported on a support bar which allows a spacing therebetween so as to accommodate the flow of water from a tap to the bath below. The structure is adapted for being mounted on the rim of a bath tub and is provided with an upstanding lip for preventing the articles positioned on the first shelf level from falling out. The plurality of bars forming the first shelf level support the structure on the rim of the bathtub. A towel rack rod connecting the halves minimizes displacement between the halves.

7 Claims, 4 Drawing Figures

BATHTUB CADDY

FIELD OF THE INVENTION

The invention relates to bathtub accessory devices for use in accommodating bath articles and the like and more particularly to devices of the type which spans conventional bathtubs to allow easy access thereto during a bath.

BACKGROUND OF THE INVENTION

A common inconvenience during a bath is that the bather often has a problem finding a specific bath article which is needed at a particular time. Usually, bath articles, such as soap, brushes, shampoo bottles, face cloths, and so forth are stored in separate locations possibly remote from the bathtub in which they are to be used. This separate placement of these articles may require not only a pre-bath searching for certain desired articles, but the use of bathroom cabinet space and other useful storage space.

SUMMARY OF THE INVENTION

It is an object of the invention to provide an improved bathtub caddy.

Yet another object of the invention is to provide an improved bathtub caddy especially suited for a bathtub which is installed in a cove or corner.

Still another object is to provide an improved bathtub caddy which is light weight but especially resistant to distortion.

It is another object of the present invention to provide a bathtub caddy or storage device for convenient placement of bath articles which caddy can be positioned across the width of the bathtub and supported thereby by the rim thereof.

In accordance with the invention, a bathtub caddy is made of two symmetrical halves, each half having a first shelf portion and a second shelf portion of greater depth than the first shelf portion. The two halves are symmetrical about a center line adapted for being positioned beneath the tap or spout of the bathtub so that a space between the two symmetrical halves allows for water flowing from the tap to pass therebetween and enter the bathtub.

The first shelf portions of the two halves are adapted to store thereon conventional bath articles such as brushes, soaps, and so forth, and serve at least in part to support the entire device on a tathtub by resting on the bathtub rim. The second shelf portions, being of much greater depth than the first shelf portions, are adapted to store therein bottles of varying height. The depth of the second shelf portions is preferably at least twice as great as the depth of the first shelf portions. The second shelf portions have a width which is less than the width of the first shelf portions so that the rear of the device may rest on the forward rim or head of the bathtub.

The device also includes a curved bar extending between the second shelf portions of each half and projecting slightly outwardly therefrom. The curved bar serves the purpose of allowing the draping of a wash cloth or towel thereon. It also prevents torsional and other types of displacement between the halves.

BRIEF DESCRIPTION OF THE DRAWING

The invention will be more readily understood with reference to the following detailed description, when taken in conjunction with the accompanying figure wherein.

DETAILED DESCRIPTION OF THE INVENTION

Figure 1:
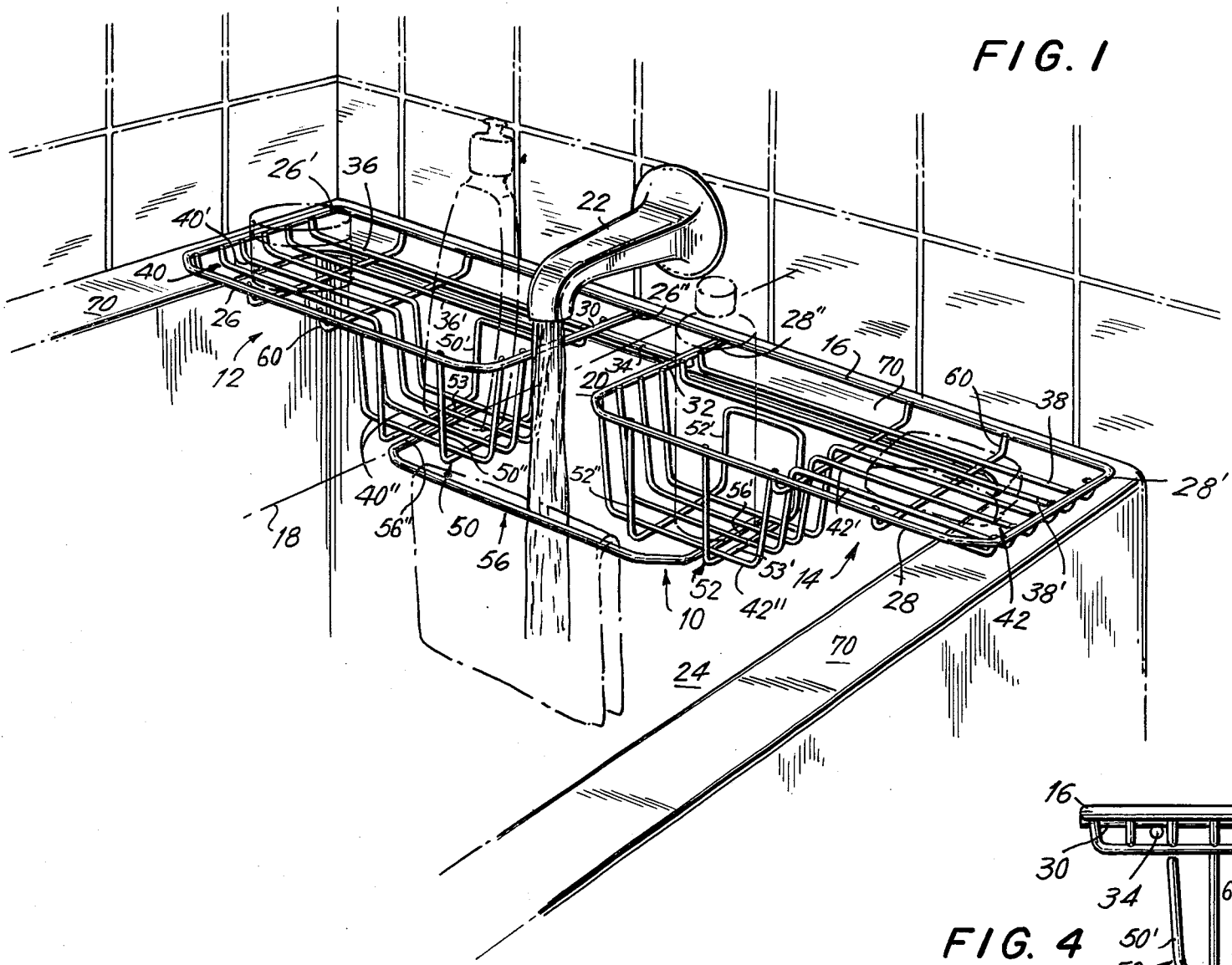
FIG. 1 is a perspective view showing the bathtub caddy of the invention positioned on the rim of a conventional bathtub.
Figure 4:
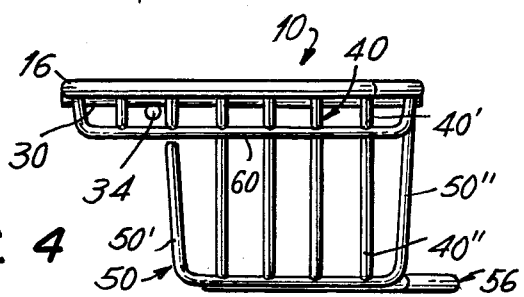
FIG. 4 is an end view of said bathtub caddy.
Figure 2:
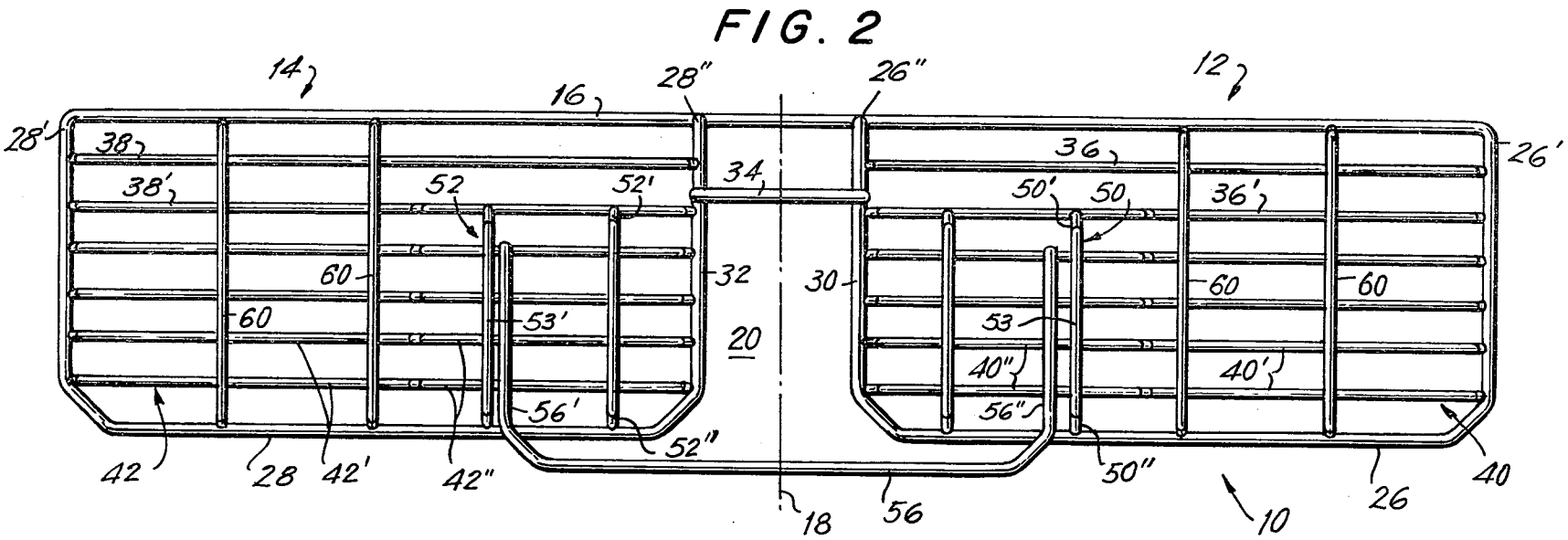
FIG. 2 is a bottom plan view of said bathtub caddy.
Figure 3:
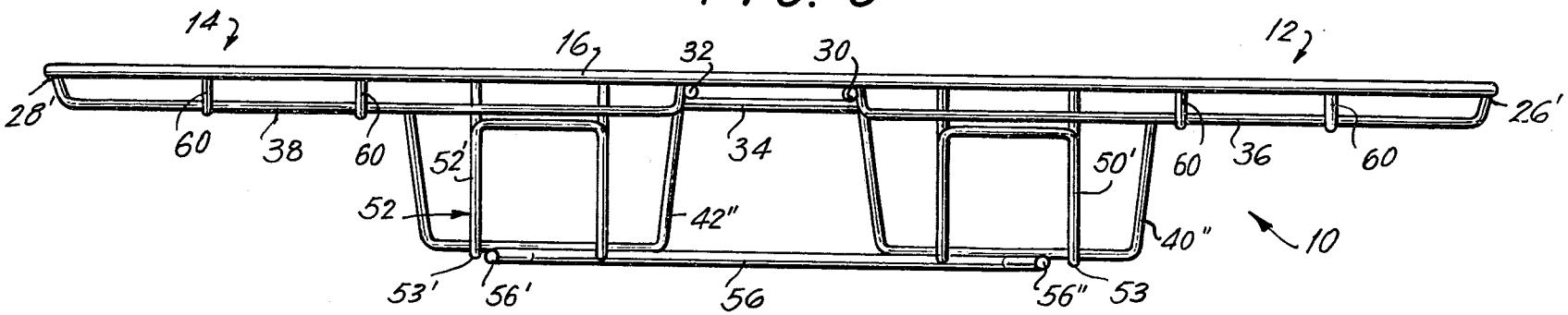
FIG. 3 is a rear view of said bathtub caddy.

Referring next ot the drawing, there is shown the tub caddy 10 of the invention. The tub caddy 10 is comprised of two identical symmetrically arranged sections 12 and 14. Each of the sections 12 and 14 is supported from a longitudinal supporting bar 16 which spaces the two sections 12 and 14 symmetrically about a vertical center plane indicated by reference character 18 so that a spacing 20 is provided for the passage of water therethrough. Such water may be discharged from a conventional tap 22 positioned above a conventional bathtub 24. The tub 24, it will be noted, is located in a cove or, for example, in a corner formed by two walls.

Each section 12 or 14 is circumscribed by a three-legged rectangularly-shaped bar portion 26, 28 respectively, each having an end 25', 28' formed integrally with the ends of the supporting bar 16, and another end 26", 28" welded to the underside of the center portion of the supporting bar 16 as seen in the drawing. The legs 30, 32 of the portions 26, 28 are also joined together by a connecting bar 34 welded to the undersides thereof.

Each of the sections 12 and 14 has at least two longitudinally extending U-shaped grills 36, 36' and 38, 38' respectively, which are welded to the inner surfaces of the two legs of the portions 26 and 28 extending transversely to the supporting bar 16. Since the grills 36, 36' and 38, 38' are U-shaped, the longitudinal straight portions thereof are situated vertically below the plane of the supporting bar 16, the supporting bar 16 thereby forming, at least in part, a lip portion for each of the sections 12 and 14 whereby bath articles stored in each of the sections are prevented from falling out. The grills 36, 36' and 38, 38' are positioned on either side of the connecting bar 34 to afford the greatest structural strength.

Each section 12 and 14 is also provided with a plurality of longitudinally extending multi-levelled grills 40 and 42 respectively. Each of the grills 40, 42 has a first portion 40', 42', respectively, identical in shape and dimension to the corresponding portions of the grills 36, 36' and 38, 38' and extends from the inner surface of one of the legs of the three-legged portions, as can be seen in the drawing. The first portions 40' and 42' lead into the second portions 40", 42" respectively, each portion 40" and 42" being U-shaped so as to form in combination a well or receptacle for storage therein of bottles and the like. The portions 40", 42" end in connection with the inner surface of the bars 30, 32 respectively.

In order to prevent bottles, or the like, stored in the wells formed by the second portions 40" and 42" from falling out, upstanding end portions 50, 52 are provided for each section 12 and 14. Each of the end portions 50, 52 is comprised of a first upstanding bar portion 50', 52' and a second upstanding bar portion 50", 52". The entire portion 50 or 52 is made of one bar formed into the shape seen in the drawing, so that the ends of the second upstanding bar portions 50", 52" are respectively welded to the inner surfaces of the legs of the three-legged portions 26, 28 that are parallel with the supporting bar 16, while each of the first portions 50', 52" has the ends thereof connected by a cross-piece formed integrally therewith. The first and second end portions of the upstanding portions 50, 52 are connected by a plurality of parallel bars 53, 53' respectively welded to the underside of the plurality of grills 40, 42 forming the wells.

A curved bar 56 having a first leg portion 56' and a second leg portion 56" is provided for the storing of wash cloths, towels, and the like. The leg portions 56' and 56" are welded to the underside of the grills 42 and 40, respectively, in a manner similar to that of the bars 53, 53' connecting the upstanding end portions 50', 50", and 52', 52". The curved bar 56 projects outwardly from a vertical plane containing therein the outer surfaces of the legs of the portions 26, 28 parallel with the supporting bar 16, so that a towel, wash cloth, or the like may be easily draped thereon. The bar also operates to prevent torsional displacement and the like between halves.

Additional support for the device is provided by transverse U-shaped cross bars 60 each having one end welded to the inner surface of the supporting bar 16, and another end welded to the inner surface of the leg parallel to the supporting bar 16 of the portions 26, 28.

The above-described bathtub caddy offers two identical sections with a space therebetween for the passage of the tap water to the bath therebelow. Each section has a first shelf level constituted by the grills 36, 36' and 38, 38', and the first portions 40', 42' of the grills 40 and 42. Brushes, soaps, and so forth may be stored at this level and will be prevented from dropping off by the lip formed by supporting bar 16 and the legs of three-legged portions 26, 28. The second shelf level, or well, is formed by the second portions 40", 42" of the grills 40, 42 and bottles and articles having a greater relative height may be stored therein. The entire structure is supported on the rim 70 of the conventional bathtub 24 by the bars and grills forming the first shelf level. Further, the bars 36, 36' and 38, 38' also serve for mounting the device on the head portion of the rim 70 positioned directly beneath the tap 22. It is, of course, to be understood that the tub caddy may be positioned anywhere along the length of the bathtub and not just at the head thereof.

From the above it can be seen that the invention may be regarded as a bathtub caddy comprising two corresponding sections each having a first and second shelf portion of different depths. A supporting bar is provided along and between the two corresponding sections. Said corresponding sections depend from said supporting bar and are in a spaced relation to each other so that water from a tap of a conventional bathtub may pass therebetween. Each of the corresponding sections further comprise a plurality of U-shaped bars extending in parallel with said supporting bar. These U-shaped bars constitute part of the first shelf portion of each of said corresponding sections. A plurality of multi-level bars are also provided in each of said corresponding sections. The multi-level bars are also parallel with said supporting bar and constitute part of said first shelf portion and said second shelf portion.

With the above-described tub caddy, all bath articles may be stored permanently therein, thereby offering additional space in the bathroom for other articles hitherto occupied by these bath articles. The tub caddy may be made of chrome-plated steel or plastic or the like and may, if of metal, be coated with plastic or rubber for decorative and protective purposes.

While a specific embodiment of the invention has been shown and described, it is to be understood that numerous changes and modifications may be made without departing from the scope and spirit of the invention.

What is claimed is:

1. A bathtub caddy comprising a first section and second section corresponding in shape to one another; means supporting said first and second sections in a spaced relation to each other, said means comprising a supporting bar extending along and between said sections; each of said first and second sections comprising first and second shelf portions depending from said supporting bar and being of different depths and being adapted for the storage of bath articles thereon, said supporting bar supporting said first and second sections in said spaced relation so that water from a tap of a bathtub may pass therebetween, each of said first and second sections further comprising a plurality of U-shaped bars extending in parallel with said supporting bar constituting part of said first shelf portion and a plurality of multi-level bars also parallel with said supporting bar constituting part of said first shelf portion and said second shelf portion.

2. A bathtub caddy according to claim 1, wherein each of said first and second sections further comprises a three-legged circumferential portion having a rectangular shape, two of the three leg portions of said three-legged portion each having one end connected to said supporting bar and a second end connected to the third leg portion, said third leg portion being parallel with said supporting bar and said two leg portions lying transverse to said supporting bar.

3. A bathtub caddy according to claim 2, wherein each of said plurality of multi-level bars comprises a first portion parallel with said supporting bar having one end connected to one of said two leg portions, said first portion being spaced from said plurality of U-shaped bars along the width of said tub caddy and being of the same elevation thereof relative to said supporting bar, and a second portion of U-shape having one end connected to the other end of said first portion and a second end connected to the other of said two leg portions, said second portion having a depth greater than said first portion and greater than said plurality of U-shaped bars.

4. A bathtub caddy according to claim 3, wherein each of said first and second sections further comprises an upstanding end portion having a first upstanding end and a second upstanding end, said first upstanding end projecting upwardly from a horizontal plane containing the lowermost parts of said second U-shaped portions to immediately below a horizontal plane containing therein the lowermost parts of said plurality of U-shaped bars, said first upstanding end being situated near the one of said plurality of second U-shaped portions nearest said supporting bar, and said second upstanding end projecting upwardly from said horizontal plane containing said second U-shaped portions to a horizontal plane containing therein said three-legged portion, said first and second upstanding ends being connected together by a plurality of bars connected to the undersurfaces of said lowermost parts of said second U-shaped portions.

5. A bathtub caddy according to claim 4, further comprising a curved bar having a first end portion connected to said second U-shaped portions of said first section, and a second end portion connected to said second U-shaped portions of said second section, and a third straight portion connecting said first and second end portions, said third portion projecting outwardly from a vertical plane containing the outer surfaces of said third leg of said three-legged portions, whereby a wash cloth or towel may be draped from said third straight portion.

6. A bathtub caddy according to claim 4, wherein said three-legged portion is approximately in the same horizontal plane as said supporting bar so that said plurality of U-shaped bars and said first portions of said plurality of multi-levelled bars extend downwardly therefrom to a horizontal plane therebelow thus forming said first shelf portions of given depth, said first portions of said plurality of multi-levelled bars extending along a portion of the length of said plurality of U-shaped bars.

7. A bathtub caddy according to claim 1, wherein said plurality of U-shaped bars extend along the entire length of the respective first and second sections, and said plurality of multi-level bars also extend the entire length of the respective first and second sections and lying parallel with and spaced from said plurality of U-shaped bars in a direction perpendicular to said supporting bar.

* * * * *